United States Patent [19]

Fraze et al.

[11] 4,286,728

[45] Sep. 1, 1981

[54] TAB AND ECOLOGY END

[75] Inventors: Ermal C. Fraze, 355 W. Stroop Rd., Dayton, Ohio 45429; Omar L. Brown, Dayton, Ohio

[73] Assignee: Ermal C. Fraze, Dayton, Ohio

[21] Appl. No.: 139,248

[22] Filed: Apr. 11, 1980

[51] Int. Cl.[3] ..... B65D 17/34

[52] U.S. Cl. ..... 220/270

[58] Field of Search ..... 220/269, 1, 273

[56] References Cited

U.S. PATENT DOCUMENTS

| | | | |
|---|---|---|---|
| 4,015,744 | 4/1977 | Brown | 220/269 |
| 4,024,981 | 5/1977 | Brown | 220/269 |
| 4,030,631 | 6/1977 | Brown | 220/269 |
| 4,084,410 | 4/1977 | Brown | 220/269 |
| 4,183,445 | 1/1980 | La Cross | 220/269 |

*Primary Examiner*—George T. Hall

*Attorney, Agent, or Firm*—Smyth, Pavitt, Siegemund & Martella

[57] ABSTRACT

A tab for easy opening ends including a lifting end and an opening end and spaced side legs is improved by the use of finger means extending from the opening end towards the lifting end, the finger means including flanges which stiffen the finger. The lifting end is formed of a smooth unbroken curl of sheet material.

14 Claims, 6 Drawing Figures

TAB AND ECOLOGY END

BACKGROUND OF THE INVENTION

1. Field of the Invention

The present invention relates to easy-opening can ends and more particularly to an improved tab of increased longitudinal strength for use as a retained tab on an improved ecology-type can end.

2. The Prior Art

It is known in the art to provide container end wall structures which include a retained tab and a retained tear strip so that in use, no container component is separated to form litter. These type containers and end structures have been referred to as ecology ends.

Typical of one form of ecology ends are those shown and described in U.S. Pat. Nos. 4,024,981 and 4,084,410 of May 24, 1977, respectively and Apr. 10, 1979, assigned to the same assignee.

U.S. Pat. No. 4,024,981 describes an improved longitudinally rigid tab and an improved end structure wherein the tab initially acts as a class 2 lever to initiate fracture of the portion of the scoreline immediately in front of the rivet. Thereafter the tab operates as a class 1 lever to complete fracture of the scoreline and to push the retained pour panel downwardly, the panel being retained on the end wall.

U.S. Pat. No. 4,084,410 relates to a tab with increased resistance to removal by bending of the tab through the provision of a plurality of bending regions.

Regardless of the details of the structure of the tab, those tabs intended to be used in ecology-type ends require substantial longitudinal rigidity especially if the tab is intended to function as a class 2 and then a class 1 lever in an opening sequence.

In the tabs described in the above patents, longitudinal rigidity was achieved by curling the side legs of the tab to provide a double thickness of metal extending essentially from the front to the rear of the tab. Additionally the front end of the tab is formed of multiple layers of sheet material, preferably of one piece.

Initially, tabs as described were manufactured from aluminum alloy sheet stock of 0.018 inch thickness, and operated satisfactorily. Such tabs included an intermediate web of material at the front end of the tab, the web including space finger elements extending rearwardly and disposed within the folds of the side legs and terminating approximately at the forward end of the aperture in the flap and through which the rivet extends to attach the tab to the end wall. This structure was found to be of sufficient longitudinal strength when the tab was fabricated of sheet stock of 0.018 inch thickness. The price of aluminum has, however, increased significally and thus, there has been a tendency to use thinner stock, i.e. 0.016 inch thick material, in the fabrication of tabs. The result has been that under certain circumstances there have been tab failures where the tabs have been fabricated of lighter stock in order to save in material costs.

For example, some beverages are packed under substantial pressure or exposed to substantial pressure during the packing operation. In such cases the scoreline normally includes a relatively high residual, i.e. the dimension of the unscored metal beneath the score area is comparatively high. The result was that in some instances, tabs of the lighter stock, i.e. 0.016 inch material, failed by bending in a zone in front of the rivet and to the rear of the front of the tab. The observed mode of failure appeared to be the pulling of the fingers out from under the curls along the side legs, or actual bending of the side legs, or both. In other instances tab failure appeared to result from the fact that the tab was misaligned, i.e. rotated about the rivet with the result that a portion of the nose of the tab was over the end wall rather than being over the pour panel, with the result that tabs of the thinner stock exhibited a tending to fail by bending, as described.

It has also been noted, in some instances that the scoreline in front of the rivet was prematurely rupturing under certain circumstances. More particularly, the tab is attached to the end wall by a rivet which passes through an aperture in the ear of the tab, the ear being located to the rear of the nose or opening end of the tab, and the scoreline including a portion immediately in front of the rivet. In some instances the end wall of the packed container is slightly bulged due to pressure developed during packing or because of the internal pressure of the container, or both.

In such cases, it is believed that the entire tab is raised a very small distance above the end wall, i.e. there is a small vertical clearance between the underside of the tab and the end wall. Normally such a clearance presents no problem, except it has been observed in some instances that there was premature fracture of the portion of the scoreline to the front of the rivet. It is believed that such premature fractures, when they occur, are caused by the normal vibration of the stacked containers during shipping.

It is believed that the vibration is transmitted to the tab and through the tab ear to the rivet with the result that the portion of the end wall around the rivet is stressed through the vibration, in a vertical direction, of the tab, the latter being free to move up and down because of the small clearance between the underside of the tab and the end wall.

SUMMARY OF THE INVENTION

The improved tab and end structure of the present invention are achieved by substantially increasing the longitudinal rigidity of the tab to such an extent that even if fabricated of thinner sheet stock, the tab has sufficient longituidinal rigidity to overcome substantially failure by bending. The improved tab also is structured such that the tab may be mounted on the end was so as to contact the end wall so that forces created by vibration are transmitted over the entire tab and to the underlying end wall rather than through the ear of the tab and to the rivet.

To this end, the fingers have been increased in length to extend rearwardly from the opening end to approximately the midpoint of the rivet opening in the ear. The fingers are also provided with flanges, extending downwardly, and which operate to increase the strength of the fingers and thus the tab in a longitudinal direction. Increase longitudinal strength is also provided by providing flange means on at least a portion of the upper layer of the side legs so that in that portion, the fingers are clamped between the layers forming the side legs.

Further, the tab ear may be oriented with respect to the body of the tab so as to be angled in a downward direction prior to assembly of the tab to a container end wall. In this way, once assembly to the end wall by the rivet, the tab is in contact with the end wall so that forces transmitted to the tab, i.e. as the result of vibration in handling and shipping of the packed containers, is transmitted through the tab to the end wall rather than through the tab ear to the rivet for localized stressing of the end wall and possible rupture of the portion of the scoreline in front of the rivet.

As will be apparent from the following detailed description, a much improved tab and container end structure are disclosed, both with reference to a preferred form of the structure, it being understood that the configuration of the tab and its appearance may vary from that described, and yet may include the features and advantages of the present invention which may be best understood by reference to the following description taken in connection with the accompanying drawings.

and

Figure 4:
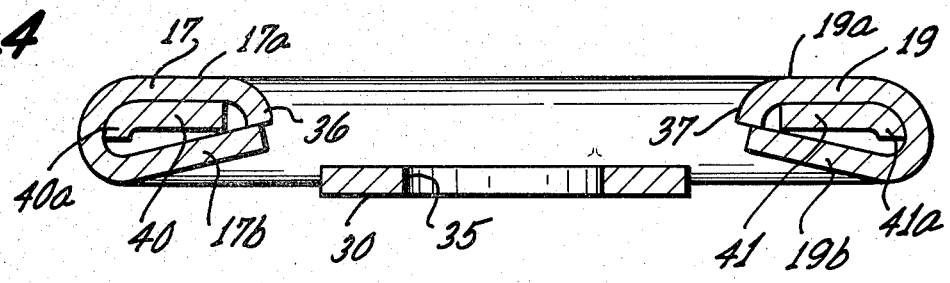
FIG. 4 is a sectional view of the tab of this invention taken transversely of the tab aproximately midway through the rivet hole.
Figure 5:
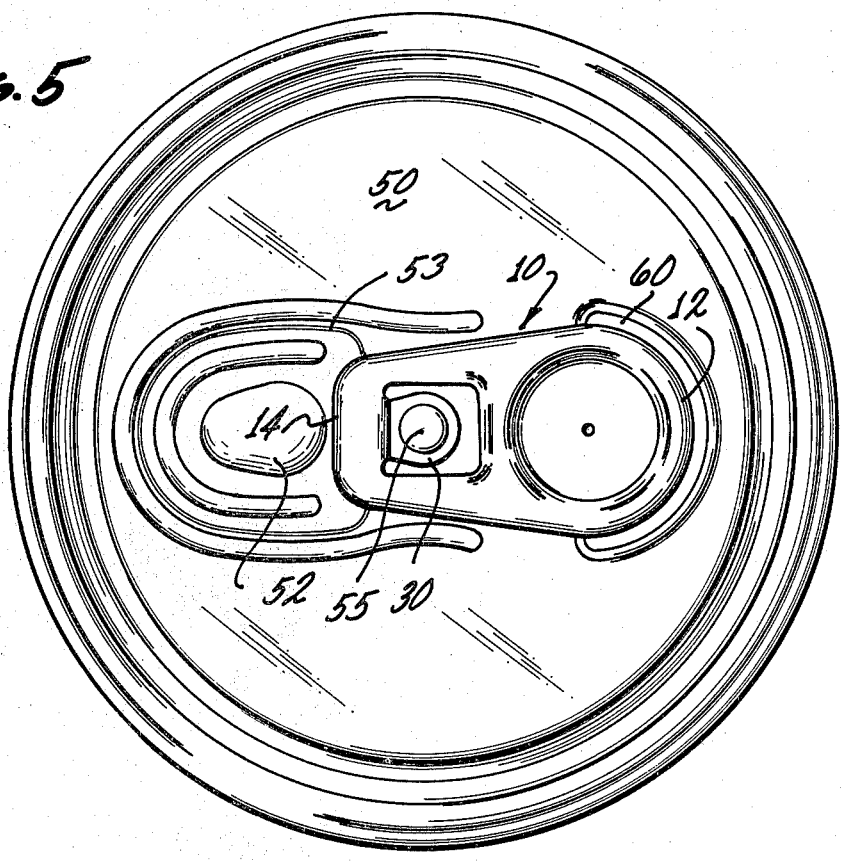
FIG. 5 is a plan view of a container end wall having mounted thereon a tab in accordance with this invention.
Figure 6:
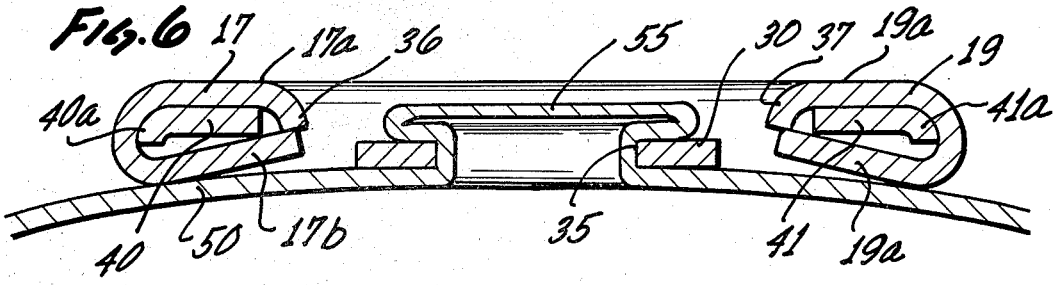

FIG. 6 is a sectional view, similar to FIG. 4, but illustrating the tab of this invention mounted on the end wall as shown in FIG. 5.

DETAILED DESCRIPTION OF THE INVENTION

Figure 1:
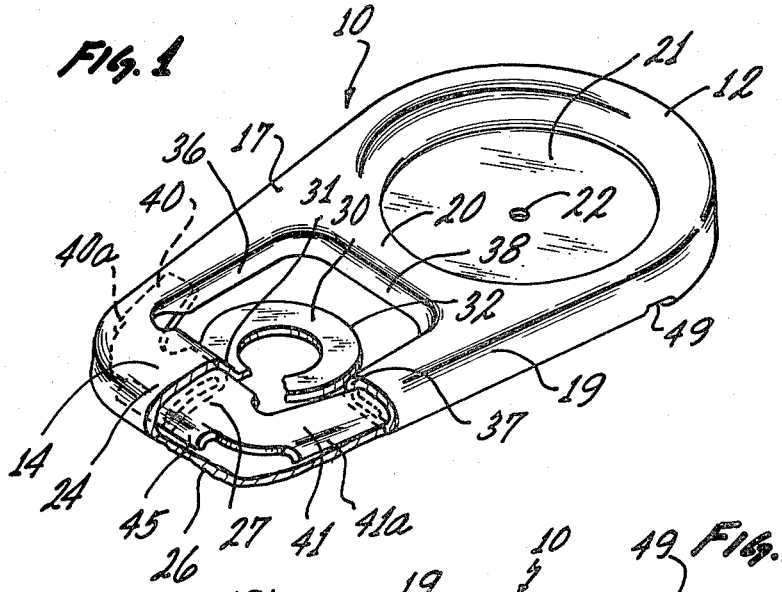
FIG. 1 is a view in perspective, with portions thereof broken away, illustrating the tab structure of the present invention.
Figure 2:
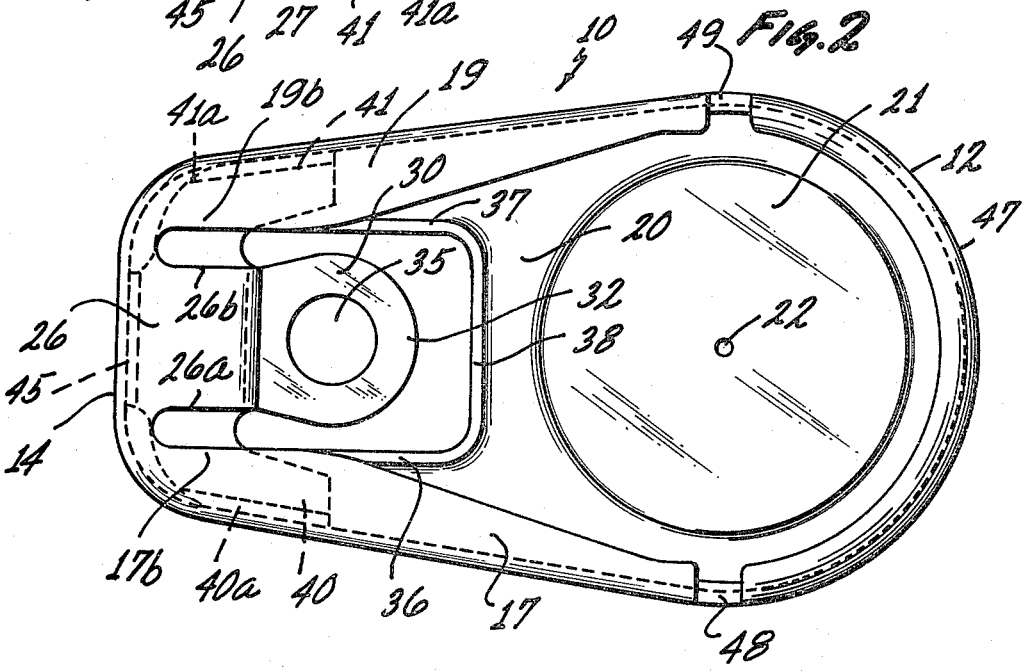
FIG. 2 is a plan view of the underside, i.e. what is sometimes called the non-public side of the tab of the present invention.

Referring to the drawings which illustrate a preferred form of the structural features of the present invention, FIGS. 1 and 2 show a tab 10 which may be formed of sheet material, for example, aluminum alloy sheet of a thickness of about 0.0016 inch or more, in the usual fashion through a progressive die set which performs a series of operations on tab sheet stock. The tab 10, which may be formed of a single sheet of material, includes a lifting end 12 at the rear end thereof and an opening end 14 at the front end thereof.

Extending from the opening end to the lifting end of the tab are spaced longitudinally extending side legs 17 and 19 each of which may be formed of a curled double layer of sheet material, as illustrated. Extending between the legs 17 and 19 and towards the rear of the tab is an upper web of sheet material 20 including a depression 21 therein, the web and depression constituting a substantial portion the upper surface of the tab. As shown there is an indexing aperture 22 used as a pilot during progressive die formation of the tab.

Figure 3:
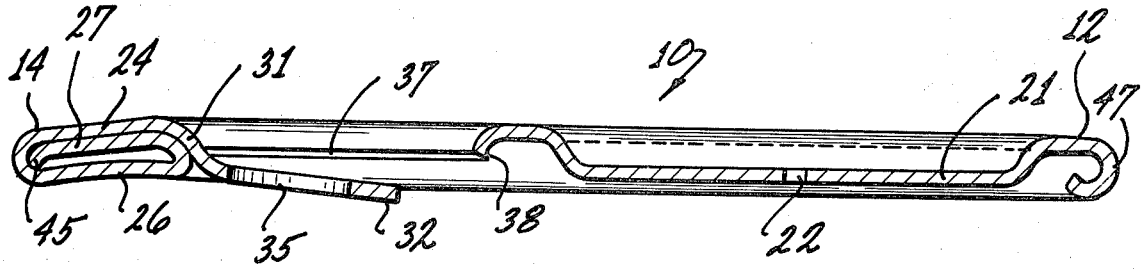
FIG. 3 is a view partly in section and partly in elevation taken along a line extending longitudinally through the center of the tab of this invention, which for purposes of illustration is of a slightly larger scale than is illustrated in FIG. 2.

As illustrated in FIGS. 1-3, the opening end 14 of the tab may be formed of multiple layers of sheet material, as illustrated, including an upper layer 24, a lower layer 26 and an intermediate layer 27. Immediately to the rear of the opening end of the tab is an ear 30 which is formed as a continuation of the upper layer 24 but which extends rearwardly and downwardly through a bend area 31. The rear end 32 of the ear extends below the front end of the tab, in the unmounted condition of the tab, as seen in FIG. 3 for reasons which will be explained. The ear is provided with an aperture 35 through which a rivet may pass for fastening the tab to an end wall.

In the form illustrated, the lower-most layer 26 has a width corresponding approximately to the width of the ear 30 in the bend area 31 and includes sides 26*a* and 26*b* which are spaced from the opposing portions lower curls 17*a* and 19*a*, respectively, at the forward end of the tab as seen in FIG. 2. Moreover, the ear 30 is spaced from each of the side legs 17 and 19 which, in the area adjacent the ear, each includes a downwardly extending flange 36 and 37 which is continuous with a flange 38 located to the rear of the ear and which forms a part of the upper web 20 of sheet material. These flanges provide strength in addition to providing a smooth contour to reduce the possibility of finger laceration.

The center layer 27 of the front end of the tab, as seen in FIGS. 1 and 2, extends the width of the front end of the tab and includes two fingers 40 and 41 extending towards the rear of the tab and terminating at approximately the centerline of the rivet aperture 35. In the form shown, the free ends of the fingers are slightly narrower than the remaining portion such that the width dimension of the finger gradually increases from the rear to the forward end. The forward end of the center layer 27 includes a downwardly forward flange 45 which extends along the sides 40*a* and 41*a* of each of the fingers 40 and 41, respectively to form a downwardly extending flange extending longitudinally along a substantial portion of the length of each finger. The longitudinally extending and downwardly depending flanges operate to increase longitudinal rigidity of the tab.

As seen in FIGS. 2 and 3, the rear end of the tab includes a smooth outer peripheral surface forward by the curl 47 which, as shown, substantially prevents contact with the free edge of metal. In fact, except for segments 48 and 49 which are used to hold the tab blank in the progressive strip during manufacture, substantially the entire outer peripheral surface of the tab is smooth and unbroken. Segments 48 and 49 each include a small segment which is folded under the follow the outer curl contour and the rip-off point is space inwardly away from the outer side surface such that in plain view it is difficult to see the rip-off section. Since this type of tab is not a pull-ring type, but one in which the finger is inserted under the rear end in an opening sequence, a smooth rear configuration has practical advantages.

As seen in FIGS. 2 and 4, each of the side legs 17 and 19 is curled to form a multiple layer leg, the upper layer 17*a* and 19*a* of which are essentially flat and coplanar with the web 20. The lower layers 17*b* and 19*b*, respectively are angled upwardly, as seen in FIG. 4, the width dimension of the legs in the vicinity of the fingers is greater than that of the respective finger such that layers substantially enclose the corresponding finger therebetween.

As shown, the inner surface 36 and 37 of the upper surface 17*a* and 19*a* of each of the legs is downwardly flanged to contact the respective lower layer 17*b* and 19*b* inwardly of the inner edge of the corresponding finger. In this way, the tendency to pull the finger out of the legs is substantially reduced. Further, the flanges 40*a* and 41*a*, respectively, on the fingers 40 and 41 and the flanges 36 and 37 respectively on the upper surface of the legs 17 and 19, tend to increase the longitudinal strength of the tab forward of the rear end 32 of the ear 30 as compared to a structure absent such flanges and of the same stock thickness.

FIG. 4 also illustrates the relative position of the ear of the tab with respect to the under surface of the tab after formation of the tab and prior to assembly to a container end wall.

To understand better the substantial improvement represented by the present invention, reference is made to FIG. 5 illustrating the tab 10 of the present invention mounted on a container end wall 50. Where applicable, the same reference numbers have been used for the parts already described. The end wall includes a pour panel 52 formed by a scoreline 53 a portion of which passes between the front end 14 of the tab and immediately in front of the rivet 55 which passes through the tab ear 30 to secure the tab to the end wall. For the remaining details of the end wall structure, reference is made to the patents previously mentioned.

In a normal opening sequence, a finger is inserted between the finger well 60 and the rear end 12 of the tab to lift the rear end. One can easily appreciate the advantage of having a tab with a smooth clean contour. Since the initial pop of the portion of the scoreline to the front of the rivet is by a class 2 lever action, lifting of the rear end of the tab causes the ear 30 to lift on the rivet, and the portion of the end wall around the rivet while the nose or front end of the tab contacts the pour panel. After the initial pop, the tab acts as a class 1 lever to break out the scoreline and push the pour panel downwardly. Thereafter the tab is normally pushed flat against the end wall.

As will be apparent, the initial pop phase of the opening sequence creates a significant stress on the tab which should remain longitudinally rigid throughout the opening sequence, especially the initial pop phase. What has been observed, especially with the prior art tabs formed of thinner sheet stock, is an occasional bending of the tab during the initial pop phase. If it occurs, the bending normally is across the width of the tab and in a band generally in the bend area 31 of the ear, and includes bending of the legs.

In come cases the tab, though initially properly secured on the end wall, may through handling in shipping and the like be rotated slightly so that the opening end of the tab overlies a portion of the end wall laterally of the pour panel, even though the end wall may be provided with dimples and the like to maintain proper tab alignment. Normally, the consumer does not align the tab, but attempts to open the container by the usual manipulation. In this circumstance what has been observed is an occasional bending of the prior art tab, as described, and in some instances the fingers of the prior art tabs have been pulled out of the curl.

The tab of the present invention, which is significantly more rigid longitudinally as compared to the prior art tabs described, substantially reduces failure by bending. Also, even if the tab is misaligned, the fingers are not pulled out of the curl, especially where the heavier grade of tab stock is used. Overall, the longitudinal rigidity has been increased through the use of flanges and extension of the finger length.

In addition the improved tab substantially reduces premature damage and even rupture of the scoreline in front of the rivet. Since most container end walls are bulged slightly (exaggerated in FIG. 6 for illustration purposes) the prior art tabs when assembled to the end wall were spaced a small distance above the wall. It is believed that vibration caused a stress to be transmitted through the tab, the tab ear to the rivet which stressed the metal around the rivet and the portion of the scoreline in front of the rivet. What was detected, on occasion, were hairline cracks in the scoreline with the result that the container contents lost all or some of the pressure i.e. became "flat" or actually leaked.

By this invention, such a problem is substantially reduced by positioning the tab ear below the underside of the tab body, as seen in FIGS. 3 and 4, during tab manufacture Thus, as the tab is secured to the end wall, as seen in FIG. 6, the underside of the tab is pulled tight against the end wall i.e. the clearance is eleminated, and downward stresses are transmitted to the end wall rather than to the rivet and the scoreline.

Accordingly, it will be seen that the structural features of the present invention have substantially improved the longitudinal rigidity of the tab, so much so that lighter tab stock may be used. Moreover, the tendency toward preventing fracture of the scoreline has been substantially reduced.

While the tab shown illustrates the preferred structural features of the present invention, it is understood that the shape and configuration of the tab may vary considerably. Thus, the panel 21 may be punched out or the rear end of the tab may be made boxier with rounded corners to provide a tab with a straight rather than curved section along the rear end. The portion of the tab to the rear of the web may be contoured to permit easy insertion of the finger.

Accordingly, various modifications may be made, as will be apparent from the above, without departing from the invention as set forth in the appended claims:

What is claimed is:

1. In a tab for use with an easy opening end structure wherein said tab is formed of metal sheet material, and which includes a lifting end and an opening end with an ear therebetween, the ear including an aperture through which a rivet may extend for attachment of said tab to an end wall, spaced side legs formed of a curled double layer of sheet material and extending between the opening end and at least to the rear of said ear, and wherein said opening end is formed of multiple layers of sheet material, the improvement comprising:

one of the multiple layers forming the opening end of said tab including finger means extending towards the lifting end of said tab and positioned within the double layer of said spaced side legs, and said finger means including flange means extending lengthwise thereof to form ribs stiffing said tab along its length.

2. A tab as set forth in claim 1 wherein said flange means extends lengthwise at least as far as the aperture in said ear.

3. A tab as set forth in claim 1 wherein said flange means is located on the portion of said finger means located within the curl of said double layer, one layer of the double layer forming the upper surface of said tab, and said flange means being disposed to face away from the upper surface of said tab.

4. A tab as set forth in claim 1 wherein the double layer of said side legs includes an upper layer forming the top surface of the tab and a lower layer therebeneath, and the lower layer overlying said finger to prevent said finger from being pulled out of said double layer during manipulation of said tab.

5. A tab as set forth in claim 1 wherein the finger is so dimensioned with respect to the lowermost layer of said curl that the lowermost layer substantially completely covers the tip end of said finger to prevent movement of said finger relative to said side leg during normal use of said tab in an opening sequence.

6. A tab as set forth in claim 1 wherein the lowermost layer of said side legs overlies the lateral inside edge of said finger means to retain said finger means within said curl.

7. A tab as set forth in claim 1 wherein said tab is formed of a single piece of sheet material.

8. A tab as set forth in claim 1 wherein the opening end of said tab includes a triple layer of sheet material, and said finger means being integral with the intermediate layer of said triple layer.

9. A tab as set forth in claim 1 wherein the opening end of said tab includes a triple layer of sheet material, and said ear being integral with one of said triple layers and including a bend area to position said ear at an angle relative to the plane of the side legs.

10. A tab as set forth in claim 1 wherein said side legs include a continuous outer curled surface and a lower layer which is interrupted at a region to the rear of the rear curl of said ear.

11. A tab as set forth in claim 1 wherein said side legs include portions spaced from said ear, and the upper layer of said side legs spaced from said ear including flange means for providing strength.

12. A tab as set forth in claim 11 wherein the flange means on said finger means and the flange means on said side legs extend in the same direction.

13. A tab as set forth in claim 11 wherein the flange means on said side legs contacts at least a portion of the lower layer of said side legs and in said portion encloses the corresponding finger means.

14. In an easy opening end wall of the ecology type for use with a container wherein the end wall includes a retained tab and a retained pour panel and wherein the tab initially functions as a class 2 lever initially to pop a portion of the scoreline and as a class 1 lever to complete fracture of the scoreline, an improved tab comprising:

a body member having an opening end and a lifting end, the opening end being formal of multiple layers of sheet material, legs formed of curled sheet material extending from said opening end to said lifting end, one of the multiple layers of the opening end including finger means received and secured within a portion of the corresponding leg, and the lifting end of said tab which is contacted by the user's finger in an opening sequence being formed of a smooth unbroken curl of sheet material.

* * * * *